US006749724B2

(12) United States Patent
Eskelinen et al.

(10) Patent No.: US 6,749,724 B2
(45) Date of Patent: Jun. 15, 2004

(54) METHOD AND ARRANGEMENT IN DOCTORING IN A PAPER OR BOARD MACHINE

(75) Inventors: Ilkka Eskelinen, Jyskä (FI); Timo Pirinen, Palokka (FI); Jukka Samppala, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/231,296

(22) Filed: Aug. 28, 2002

(65) Prior Publication Data

US 2003/0057629 A1 Mar. 27, 2003

(30) Foreign Application Priority Data

Sep. 6, 2001 (FI) ..... 20015027

(51) Int. Cl.[7] ..... D21F 3/00

(52) U.S. Cl. ..... 162/199; 15/256.51; 15/256.53; 162/272; 162/358.1; 162/360.2

(58) Field of Search ..... 162/272, 199, 162/281, 358.1, 360.2, 360.3; 15/256.51, 256.53

(56) References Cited

U.S. PATENT DOCUMENTS

| | | | | | |
|---|---|---|---|---|---|
| 4,642,839 | A | * | 2/1987 | Urban | 15/256.3 |
| 5,032,229 | A | * | 7/1991 | Boucher | 152/281 |
| 6,319,364 | B1 | * | 11/2001 | Ekstrom | 162/281 |
| 6,544,388 | B2 | * | 4/2003 | Dennis | 162/272 |

FOREIGN PATENT DOCUMENTS

| | | |
|---|---|---|
| FI | 852265 | 12/1985 |

* cited by examiner

*Primary Examiner*—Peter Chin
(74) *Attorney, Agent, or Firm*—Fildes & Outland, P.C.

(57) ABSTRACT

A method and arrangement in doctoring in a paper or board machine is disclosed in which the web travels through at least one press nip, in which the press nip is formed by at least a press roll and its backing roll and in which at least one roll is doctored using at least one doctor device. The press roll is doctored essentially over the width of the web.

15 Claims, 4 Drawing Sheets

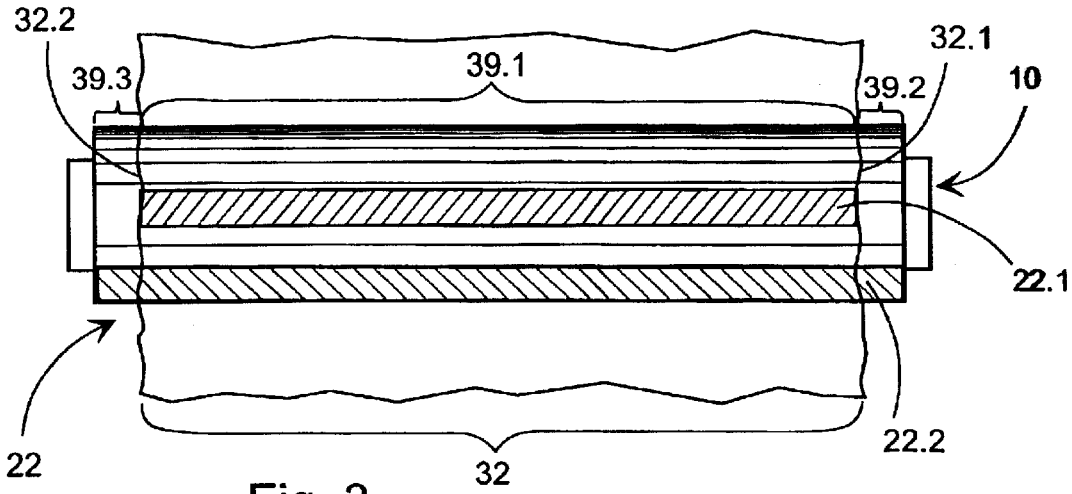
Fig. 3
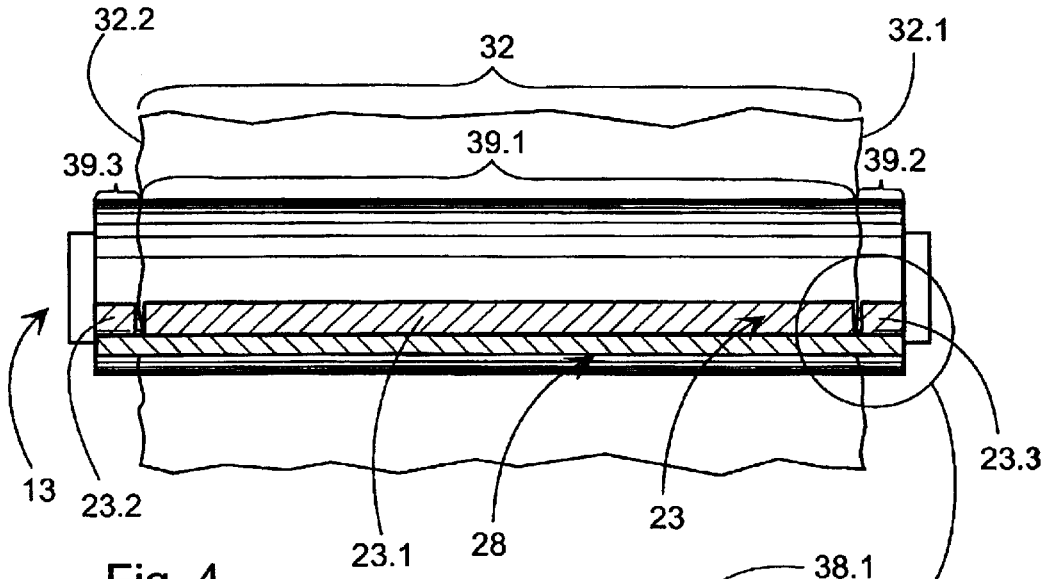
Fig. 4
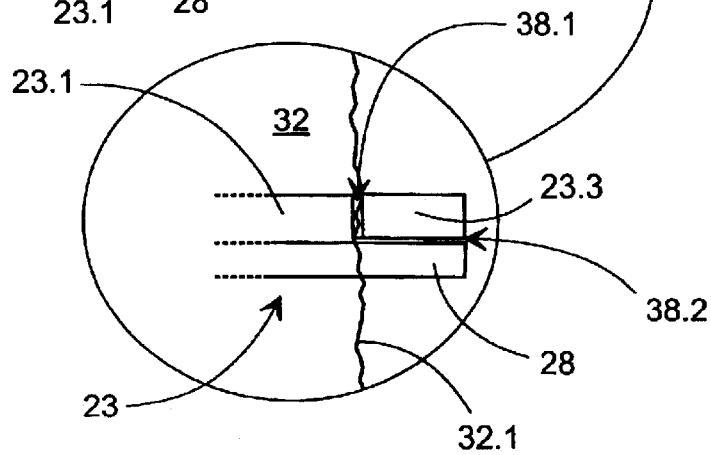

METHOD AND ARRANGEMENT IN DOCTORING IN A PAPER OR BOARD MACHINE

FIELD OF THE INVENTION

The present invention relates to a method and arrangement in doctoring in a paper or board machine, in which the web travels through at least one press nip, in which the press nip is formed by at least a press roll and its backing roll and in which at least one roll is doctored with the aid of at least one blade device.

BACKGROUND OF THE INVENTION

Particularly in the wet end of a paper or board machine, which is generally understood to include at least the wire section and the press section, material from the wet web adheres to the rolls. The adhering material consists of, for example, fibers and fillers, which are formed of particulate material such as mineral fines. Impurities of this kind gathering on the roll result in, among other things, the web sticking to the roll surface and in runnability problems in the form of plucking, leading to an increase in web breaks and thus to production losses.

An essential part of roll maintenance and cleaning to remove the impurities collecting on them is their doctoring, for example, using special blade devices. In doctoring, the blade of the doctor is loaded in a known manner against the roll, in order to scrape off the impurities that have collected on the roll.

Several different types of doctoring devices are known, such as single and double-bladed doctors and those having different kinds of blade holder. Nowadays, for example, in critical roll positions in the press section of a paper machine, it is usual to use double doctors, in which two doctor blades of essentially the same length are attached to a single blade holder. The doctor blades are of the same length as the surfacing of the roll being doctored. The use of such a double-blade arrangement results in, among other things, better cleaning.

Though the blades are made from hard materials, uneven wear is nevertheless one of the problems arising when using doctor blades. Uneven wear causes a substantially dirtier area to form on the roll surface than at its edge areas. The area forms essentially at the roll segment directly in contact, for example, with the web travelling through the press nip, or indirectly in contact with the said web due to, for example, a felt remaining between the web and the roll.

Due to the differences in the cleaning of the said roll segments, a sharp, step-like discontinuity point, or burr, shown in FIGS. 1*a* and 1*b* depicting the state of the art, forms in the doctor blade at precisely a location corresponding to that point on the roll, with which the edges of the web are in either the said direct, or indirect contact. The detriments caused by the burr 40 can be reduced by inducing oscillation in the blade 23'. Though oscillation results in a less sharp formation of burrs 40, the blade 23' still has a substantially weaker contact with the roll 10 being doctored than a newly-changed, unworn blade, for instance, will have, thus also leading to substantially poorer cleaning efficiency. The life of the blades 23', 24' may vary from as little as 2 hours to a few days. This also causes production losses, as the machine must generally be stopped to change the blades 23', 24'.

During oscillation, the doctor blade is moved parallel to, and against the roll, for example, 2–3 times a minute, the roll velocity being 20–30 m/s. There are problems in maintaining continuous oscillation. For example, oscillation may be out of operation for even long periods due to a device fault, because its repair may need the entire machine to be stopped, which is generally not justified only to repair an oscillation device. In certain situations it may even be felt to be a nuisance to arrange the functioning oscillation that is necessary for the above reasons.

Further, especially in the threading stage, in which the edge band of the web is fed in stages through the machine, the deficient cleaning caused by the said burr in the doctor blade leads to significant problems. Especially at the wet end of the paper machine, the paper web is particularly sensitive to any impurity collecting on the roll. For example, impurities can make the web stick onto the roll, which is precisely one of the commonest problems causing difficulties in threading.

The manufacturing materials of the rolls being doctored have also developed. Nowadays, many rolls surfaced with, for example, rubber and composite materials are used, for their heat resistance among other reasons. However, these roll surfacings are much more susceptible to damage than traditional stone rolls, partly due to aforesaid burr that forms in the doctor blade.

At present, the construction of doctor blades can also be surfaced, at least over the width of the essentially dirtiest area of the roll being doctored and over which the roll is in either direct or indirect contact with the web. However, even the use of such special surfacing solutions is insufficient to effectively improve the grip of the blade against the roll being doctored. The blade still wears more rapidly over the width corresponding to the web than over the essentially cleaner edge segments of the roll.

SUMMARY OF THE INVENTION

The invention is intended to create a new type of method and arrangement in doctoring in a paper or board machine.

Accordingly a method in doctoring in a paper or board machine, in which the web travels through at least one press nip, in which the press nip is formed by at least a press roll and its backing roll and in which at least one roll is doctored by at least one doctor device, is characterized in that the press roll is doctored over essentially the width of the web. And the arrangement in doctoring in a paper or board machine, in which the web is arranged to travel through at least one press nip, which is arranged to be formed by at least one press roll and its backing roll and in which at least one of the said rolls is arranged to be doctored by means of at least one blade device, is characterized in that the doctoring of the roll with the blade device is arranged to take place over three roll segments, in which are arranged

- first blade devices arranged essentially closer to the web for doctoring the said first roll segment area, which is arranged to cover essentially that area of the roll, which is in direct or indirect contact with the web arranged to travel through the nip and
- second blades devices, which are arranged to doctor at least the edge segments of the roll that remain outside of the said first roll segment.

By means of the method and arrangement according to the invention, a considerably better grip of the doctor blade is maintained, despite the wear in the blade. This significantly improves, among other things, the cleaning of the roll, and achieves substantially easier threading, as well as reducing the number of so-called edge-fraying breaks.

Further, as one preferred embodiment, the oscillation of the doctor blade can even be shut off completely, or else operated for a much shorter time than in the state of the art, as there is essentially no formation of a burr caused by differences in blade wear due to the differences in cleanliness of the different segments of the roll, when the roll is doctored with the aid of the method according to the invention.

The method and arrangement according to the invention can be advantageously implemented both in known double-doctor constructions and even in simple single-blade doctors. Though the method and arrangement according to the invention are preferably applied particularly in the press section of a paper or board machine, they can also be advantageously used in other corresponding operating locations requiring doctoring.

These and other features and advantages of the invention will be more fully understood from the following detailed description of the invention taken together with the accompanying drawings.

BRIEF DESCRIPTION OF THE DRAWINGS

In the drawings:

FIG. 3 shows the doctor blade arrangement according to the invention;

FIG. 4 shows a second embodiment of the doctor blade arrangement according to the invention.

DETAILED DESCRIPTION OF THE INVENTION

Figure 2:
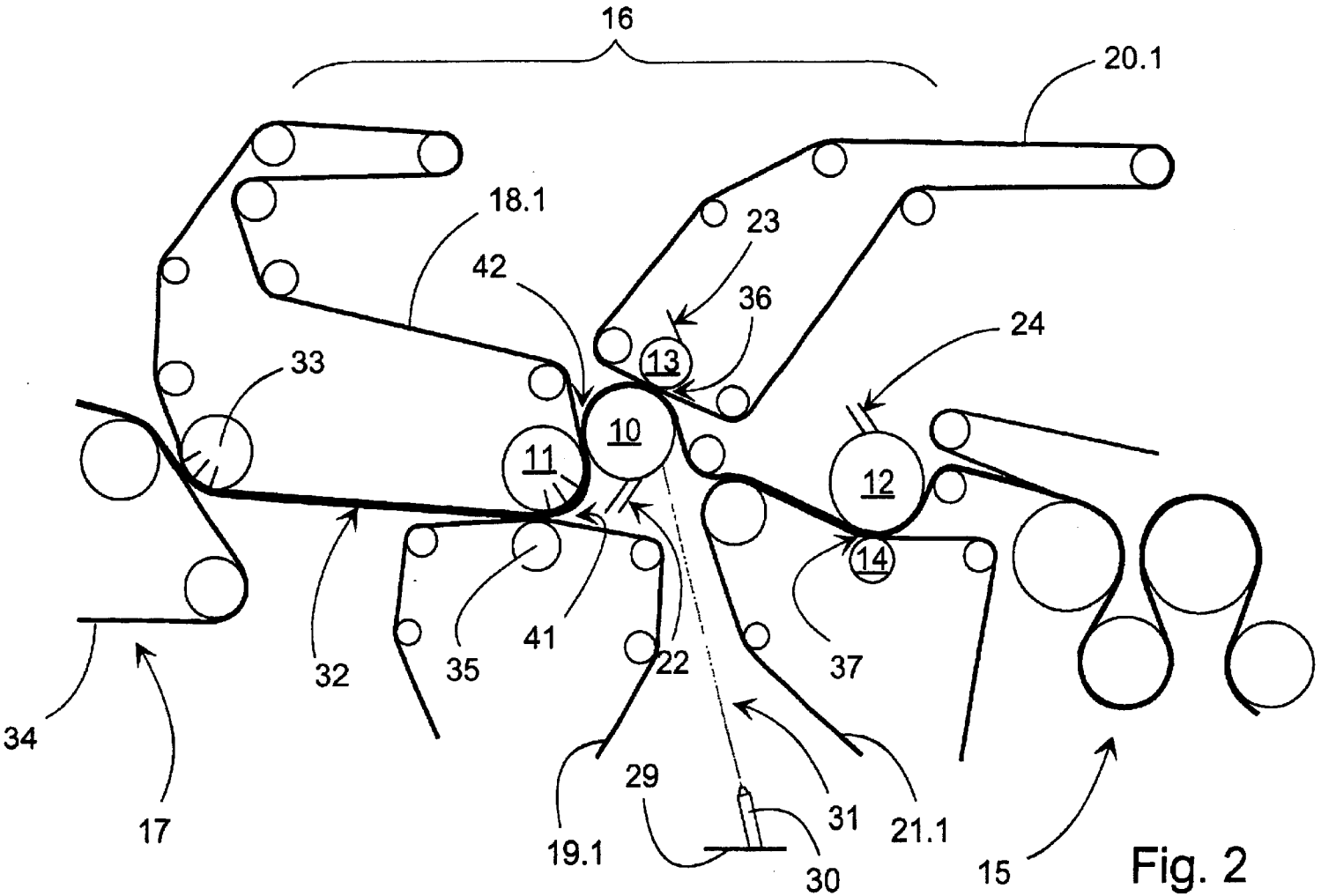
FIG. 2 shows an example of the press section of a paper machine.

Referring now to the drawings in detail, FIG. 2 shows one preferred application of the method according to the invention in a paper machine. With the aid of the method and arrangement, significant advantages are gained, particularly in the press section 16 of a paper machine, the web 32 being led through which still having a relatively high moisture content when it is brought from the wire section 17 and before it is led to the dryer section 15.

The paper web 32 is led to the press section 16 from the wire 34 of the wire section 17 with the aid of, for example, a so-called vacuum pickup, i.e. a pickup suction roll 33, which can be so-called zone-adjustable. From the pick-up suction roll 33, the wet paper web 32 is easily made to adhere to the pick-up felt 18.1, which is also called the $2^{nd}$ press felt.

Next, the paper web 32 is led between the pick-up felt 18.1 and the $1^{st}$ press felt 19.1 to the first press nip 41, formed by the suction roll 11 and its grooved backing roll 35, in which water is sucked out of it through the pick-up felt 18.1. The $1^{st}$ press felt 19.1 remains between the paper web 32 and the backing roll 35.

A second press nip 42 is formed between the suction roll 11 and the center roll 10. The paper web 32 is led on from the second nip 42, supported by the pick-up felt 18.1 on the suction roll 11, to the center roll 10 of the press, and adheres to its smoother surfacing, in preference to the rough pick-up felt 18.1. In the example, a third press nip 36 is formed in the press section 16 by the center roll 10 and its backing roll 13. In the third press nip 36, the paper web 32 is pressed between the said rolls, in such a way that a $3^{rd}$ press felt 20.1, to which the pressure in the nip 36 makes the water advantageously transfer, is taken through the said press nip 36 between the backing roll 13 and the paper web 32.

Nowadays, the said third press nip 36 may be followed by a so-called fourth press 37. In it, a smooth roll 12 presses the paper web 32 against a grooved backing roll 14, to transfer the water from the paper web 32 to a $4^{th}$ press felt 21.1.

In the press section 16, doctoring is arranged at least on the rolls that are in direct or indirect, for example through the felts, contact with the paper web 32, in order to keep them clean. Fibers and other fines, for example, adhere from the wet paper web 32 to the smooth rolls, essentially over the width of the web 32, so that if doctoring was not arranged the runnability of the machine would suffer. Problems appear, such as the paper web 32 sticking onto the rolls, which nearly always causes a break.

FIG. 2 shows examples of possible locations for double-bladed doctor devices 22, 24, which can be so-called double doctors in a common doctor holder, or two separate doctor blades, which are both arranged in their own holder. Single-blade doctors 23 can also be used in positions suitable for them, such as on the backing roll 13, of the center roll 10, in which the $3^{rd}$ press felt 20.1 lies between the paper web 32 and the backing roll 13.

FIG. 3 shows an embodiment of an arrangement implementing the method according to the invention. In it, two doctor blades 22.1, 22.2, which may be, for example, both in their own blade holder (not shown), or which may also form a so-called double-doctor construction (not shown), are arranged to clean a roll, such as the said center roll 10. In reality, in a double-doctor construction the blades 22.1, 22.2 are considerably closer to each other than shown, so that, in precisely the case of the said double doctor 22, the distance of the blades 22.1, 22.2 from each other is not that shown. FIG. 3 shows the paper web 32, to illustrate the width of the roll segment 39.1, over which the web 32 is in contact with the roll 10.

According to the method of the invention, the roll 10 is used to doctor essentially over the width of the web 32, which corresponds to the roll segment 39.1. The area 39.1 can either be the area directly covered by the paper web 32 or, in the case of the backing roll 13, for example, the area of the backing roll 13 indirectly covered through the $3^{rd}$ felt 20.1. The edges 32.1 and 32.2 of the paper web 32 delimit precisely the edge locations of the roll segment 39.1 to be doctored.

In the arrangement, the first doctor blade 22.1 is arranged to doctor the roll 10 over this said area 39.1, covering the width of the web 32, in order to keep it clean. The second doctor blade 22.2 is arranged to doctor the roll 10 not only over the roll segment 39.1 in contact with the above paper web 32, but also over the essentially cleaner segments 39.2, 39.3. The use of the arrangement achieves a considerably improved grip of the blades 22.1, 22.2 on the roll 10 and thus also an improved cleaning result.

FIG. 4 shows a second preferred embodiment of an arrangement implementing the method according to the invention. In this embodiment, for example, the doctoring of the backing roll 13 can be implemented in the case of a single doctor blade 23 in such a way that a saw cut 38.1 is arranged in the doctor blade 23, at the points in the roll 13 corresponding to the edges 32.1, 32.2 of the paper web 32. The saw cut 38.1 creates a flexible lightening in the blade 23, essentially permitting a firm and even doctor-blade contact against the roll 13, as much in the roll segment 39.1 in contact with the paper web 32 through the $3^{rd}$ press felt 20.1, as in the roll's 13 edge segments 39.2, 39.3, which are not in contact with the said paper web 32 through the $3^{rd}$ press felt 20.1.

Figure 1A:
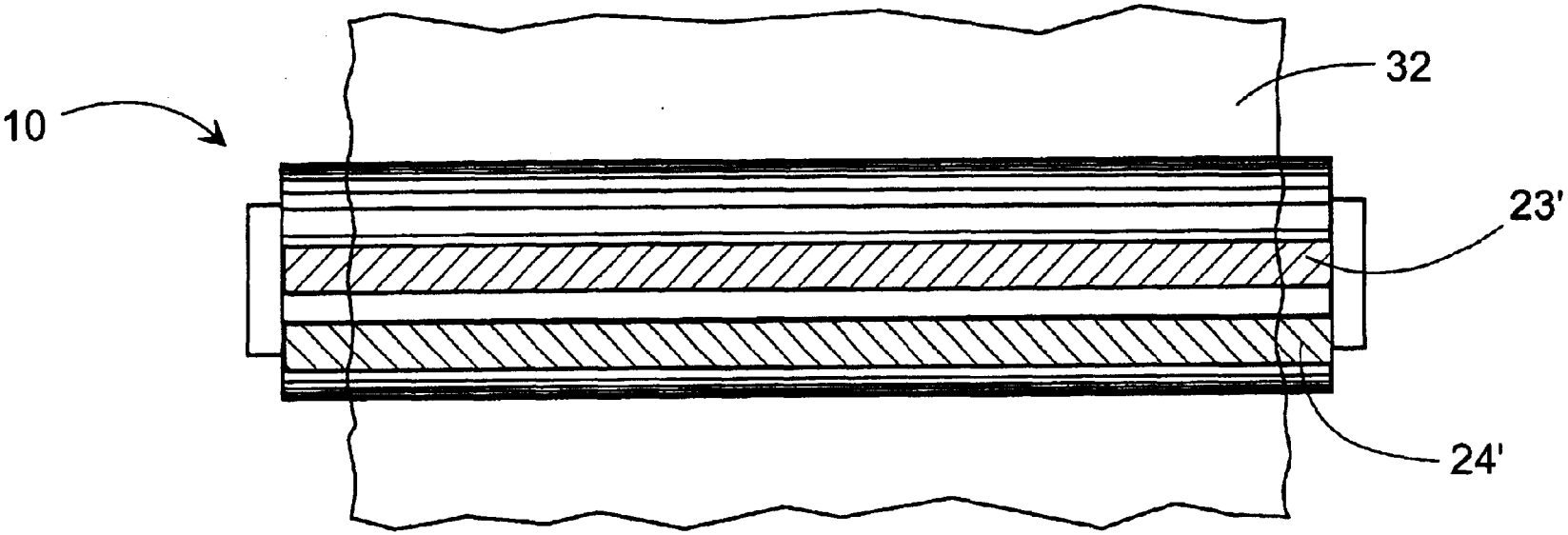
FIGS. 1*a* and 1*b* show a general view of the state of the art and its related problem.
Figure 1B:
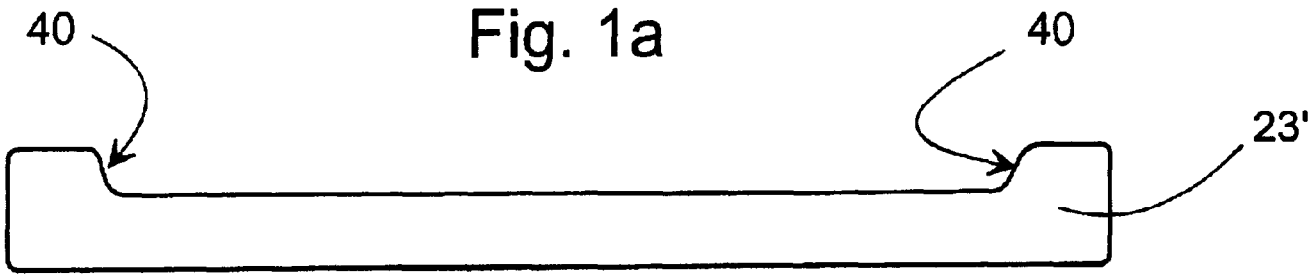

Because the saw cut 38.1 is essentially at the point of the edges 32.1, 32.2 of the paper web 32, the sharp burr 40 arising in the blade 23' in solutions according to the state of the art, as shown, for example, in FIG. 1, cannot arise. Thus, the lightening areas 23.2, 23.3 arranged in the edge parts of the blade 23 permit a substantially better grip in the central part 23.1 of the blade 23 than that of the unified blade construction 23', according to the state of the art, which extends to the ends of the roll 10 and is shown in FIG. 1.

The saw cut can be arranged at the point of the edges 32.1, 32.2 of the paper web 32, either parallel to the web or in the lightening area 23.2, 23.3 of the blade 23 outside the paper web 32, parallel to the blade holder 28. In that case, the saw cut 38.2 is preferably at the root of the doctor blade 23, essentially close to its holder 28, extending from the edges of the blade 23 at a distance from the edges 32.1, 32.2 of the paper web 32.

Figure 5:
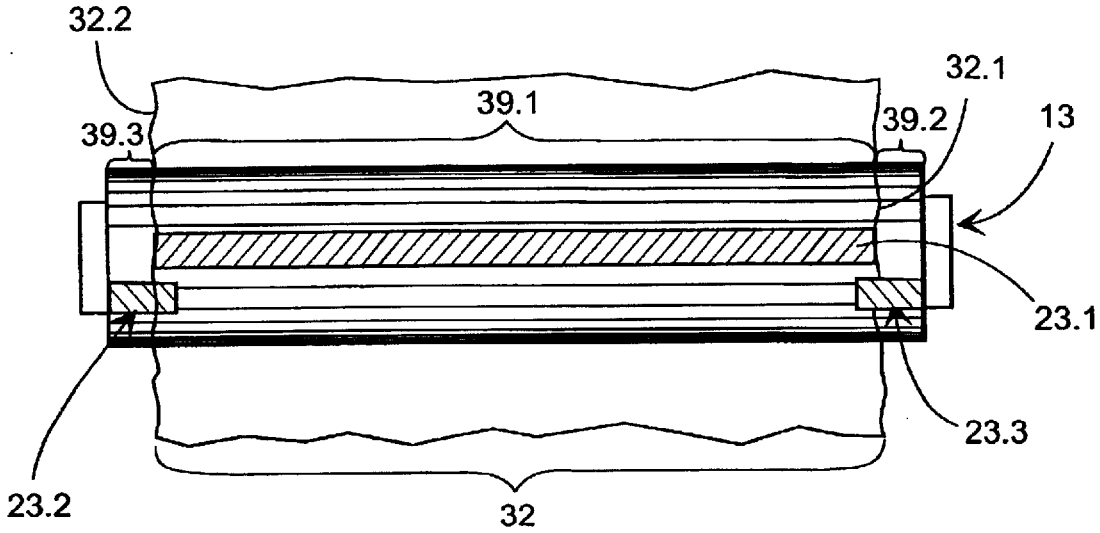
FIG. 5 shows a third embodiment of the doctor blade arrangement according to the invention.

FIG. 5 shows a third preferred embodiment of an arrangement implementing the method according to the invention. In this embodiment, a separate blade 23.1 with its own blade holder (not shown) is arranged in a precisely delimited roll segment 39.1. The roll segments 39.2, 39.3 that lie outside the web 32 have their own separately arranged doctors 23.2, 23.3, which doctor the corresponding external segments 39.2, 39.3 of the roll 13 and the web 32 as well as the web 32 for a distance from the edges 32.1, 32.2 towards the center of the web. The said distance can be preferably, for example, in the order of the set oscillation length, i.e. 2–20 mm.

FIG. 2 shows one preferred embodiment for aligning the paper web 32 with the said precisely delimited roll segment 39.1 of the center roll 10, which is doctored, for example, with the aid of the preferred embodiment shown in FIG. 3. For the alignment, laser indicating devices 30, for example, are located in the basement of the machine hall, beneath the press section 16. When the laser beam 31 created by the indicating devices 30 is detected from the surfacing of the roll 10, the blade 22.1 of the doctor is set to allow for possible oscillation, so that it will correspond to the desired width of the paper web 32.

The beam 31 is used to determine the edges of the blade 22.1 and their location and the distance between them, after which the values obtained are used to set the width of the web 32 according to the edges of the blade 22.1, for example, using the web pipes, to be essentially greater than the width of the blade 22.1 doctoring the said roll segment 39.1. Next, the width of the paper web 32 is adjusted by the suction zones of the pick-up suction roll 33 of the wire section 17, so that the paper web 32 corresponding precisely to the width of the said blade 22.1 of the doctor 22 is led to the press section 16, in such a way that it is also aligned precisely to the roll segment 39.1 doctored by the said blade 22.1. The ragged edge areas of the web 32 coming from the wire section are dropped by means of the said arrangement into a pulper (not shown) located in the basement 29. From the roller areas of the pick-up suction roll 33, in which the suction is operating, the paper web 32 continues to travel to the press section 16, supported by the pick-up felt 18.1. Other alignment methods than that described can also be advantageously used.

As the blades wear essentially evenly over their entire width when using the method according to the invention and the arrangement implementing it, the burr that appears on the roll at the points on the blades corresponding to the edge of the paper web in the solutions according to the state of the art does not arise. This also allows the oscillation of the doctor blade to be arranged to be shorter and less frequent that before, or for it to be left totally out of operation. According to one preferred embodiment, the oscillation of the blade 22.1 can be arranged to essentially cover the width of the web 32, so that the blade 22.1 is essentially narrower than the web 32. If the total length of the oscillation is, for example, 16 mm, when the blade 22.1 is in the center of the web its ends are 8 mm narrower than the paper web 32. 2–10 mm, for example, can be used as an effective oscillation length, (5–20 mm on tissue paper machines). Thus, the effective width of the blade 22.3 corresponds essentially to the width of the web 32.

The method and arrangement according to the invention are not limited to any particular type of doctor. They can be advantageously used, for example, both in double doctors, in which two blade are used that are attached to the same blade holder, and also in doctor solutions with two separate consecutive blades or only a single blade. The blade materials that can be used include glass fibre, carbon fibre, plastics, composites, and steel, if oscillation is used when doctoring. In the method and arrangement according to the invention, the blade can be installed either manually or automatically.

Significant advantages are achieved with the aid of the method and arrangement according to the invention, including substantially easier threading. In addition to this advantage, the operating life of the blades can also be significantly extended, as when the method according to the invention is used they wear essentially more evenly in all areas. In pilot tests, it has been observed that, when the arrangement according to the method of the invention is used, the blade wear was only about 35 mm in 7 days.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A method in doctoring in a paper or board machine, in which a web travels through at least one press nip, the press nip is formed by at least a press roll and its backing roll each having a center segment with edge points and two edge segments, said center segment being in direct or indirect contact with the web and said edge segments not contacting the web, and at least one roll is doctored by at least one blade device, characterized in that said center segment of the roll is doctored while doctoring of said edge segments is avoided.

2. A method according to claim 1, characterized in that the doctoring takes place without oscillation.

3. A method according to claim 1, characterized in that the web is aligned, before said doctoring, with said center segment of the roll defined by the location of the blade devices.

4. A method according to claim 1, characterized in that the doctoring takes place with oscillation, which is essentially shortened and less frequent.

5. A method according to claim 1, characterized in that the width of the web is arranged before the doctoring of the roll to be twice as wide as the effective oscillation length of the blade device performing the doctoring of the center segment of the roll corresponding o the width of the web.

6. A method according to claim 1, characterized in that the web is aligned with said center segment of the roll in stages, in such a way that indicator devices are used to define the edge points of said roll's center segment, the preferred alignment of the web is defined according to said edge points, and said alignment is set for the web essentially before said precisely doctored roll's center segment.

7. An arrangement for doctoring in a paper or board machine, in which a web is arranged to travel through at least one press nip, said press nip being arranged to be formed by at least one press roll and its backing roll which each have a center segment with edge points and two edge segments, said center segment being in direct or indirect contact with the web and said edge segments not contacting the web, and in which at least one of said rolls is arranged to be doctored by means of at least one blade device, characterized in that the doctoring of the roll with said blade device is arranged to take place over three roll segments, in which are arranged first blade devices arranged essentially closer to the web for doctoring said center segment of the roll, which is arranged to cover essentially that segment of the roll that is in direct or indirect contact with the web arranged to travel through the nip, and second blade devices, which are arranged to doctor at least the edge segments of the roll that remain outside of said center segment of the roll.

8. An arrangement according to claim 7, characterized in that at least some of the said blade devices are arranged not to oscillate.

9. An arrangement according to claim 7, characterized in that at least some of the said blade devices are arranged to oscillate.

10. An arrangement according to claim 7, characterized in that double-doctor devices are arranged to form the said blade devices.

11. An arrangement according to claim 10, characterized in that the said second blade devices are arranged to doctor the roll over its entire width.

12. An arrangement according to claim 7, characterized in that the blade devices covering the said edge segments are fitted with their own separate blade holders.

13. An arrangement according to claim 7, characterized in that the said blade devices are arranged essentially from a single blade device, in which a flexible saw cut parallel to the web is arranged essentially at a point corresponding to the edges of the web.

14. An arrangement according to claim 13, characterized in that a flexible saw cut essentially parallel to the blade holder, which is arranged to cover the edge segments of the said roll, is arranged in the said second blade devices.

15. An arrangement according to claim 7, characterized in that laser indicator devices are fitted to the arrangement, to define at least one of the location and width of the said first blade devices.

* * * * *